US005681451A

United States Patent [19]

Hart

[11] Patent Number: 5,681,451

[45] Date of Patent: Oct. 28, 1997

[54] SETTLING AIDS FOR SOLIDS IN HYDROCARBONS

[75] Inventor: Paul R. Hart, The Woodlands, Tex.

[73] Assignee: BetzDearborn Inc., Trevose, Pa.

[21] Appl. No.: 594,221

[22] Filed: Jan. 31, 1996

[51] Int. Cl.[6] ..... C10G 29/00

[52] U.S. Cl. ..... 208/177; 585/865; 585/866

[58] Field of Search ..... 208/177, 188; 585/865, 866

[56] References Cited

U.S. PATENT DOCUMENTS

| | | | |
|---|---|---|---|
| 2,952,620 | 9/1960 | Wade | 208/162 |
| 3,945,955 | 3/1976 | Ihde, Jr. | 260/2.5 P |
| 4,407,707 | 10/1983 | Merchant, Jr. et al. | 204/190 |
| 4,539,099 | 9/1985 | Merchant et al. | 208/177 |
| 4,559,133 | 12/1985 | Siegfried et al. | 208/177 |
| 4,600,500 | 7/1986 | Dickakian | 208/177 |
| 4,692,237 | 9/1987 | Hsu et al. | 208/177 |
| 4,889,618 | 12/1989 | Tyson, Jr. et al. | 208/177 |
| 5,196,630 | 3/1993 | Agrawal et al. | 585/860 |
| 5,401,439 | 3/1995 | Elferrs et al. | 252/358 |
| 5,476,988 | 12/1995 | Hart | 585/860 |
| 5,481,059 | 1/1996 | Brock et al. | 585/866 |

*Primary Examiner*—Helane Myers
*Attorney, Agent, or Firm*—Alexander D. Ricci; Philip H. Von Neida

[57] ABSTRACT

Disclosed are methods for accelerating the settling of finely divided, oil-and-water-insoluble solids in hydrocarbon fluids using an effective amount of an alkylphenol-formaldehyde resin alkoxylate having a molecular weight of about 500 to about 5,000. Preferably, the hydrocarbon is a fluid catalytic cracker slurry containing spent catalyst fines.

12 Claims, No Drawings

SETTLING AIDS FOR SOLIDS IN HYDROCARBONS

FIELD OF THE INVENTION

The present invention relates to methods for accelerating settling of solids in hydrocarbon fluids. The methods of the present invention are particularly efficacious at accelerating the settling of FCC catalyst fines in an oil slurry.

BACKGROUND OF THE INVENTION

Unrefined hydrocarbons such as crude oil, resids and bottom streams often contain finely divided solid matter which often must be removed prior to further use or processing. These solids can include solids of a soil-like nature, finely divided silicas, clays, silt and coke, and metal oxide and sulfide corrosion solids. These solids may include traces of metal particles such as lead, nickel, chromium and the like, and salts thereof.

For instance, fluid catalytic cracker (FCC) units use a fluidized bed of zeolite type aluminosilicate clay particles to crack heavy petroleum fractions into lighter fractions at elevated temperatures. The catalyst is eventually deactivated by poisoning or coking. These spent fines must be removed from the FCC on a continual basis so that fresh catalyst can be added.

Some of this slurry oil containing the spent fines is then typically settled in tankage, though hydrocyclones are sometimes used to accelerate the separation process. Both native and synthetic components of the slurry oil have a dispersant effect which retards the settling of the fines.

The present inventor has discovered that certain chemical agents, when added to the slurry oil, have an anti-dispersant or coagulant effect which accelerates the settling process. This produces a cleaner decant oil (typically <0.05 wt % ash) in a shorter period of time and can then be sold as carbon black feedstock or residual fuel oil.

DESCRIPTION OF THE RELATED ART

U.S. Pat. No. 4,539,099 describes a method to enhance the gravity settling rate of suspended solids from hydrocarbon oil by the addition of an oxyalkylated phenol formaldehyde resin glycol ester. U.S. Pat. No. 5,476,988 describes the use of quaternary ammonium compounds and U.S. Pat. No. 5,481,059 describes the use of polyacrylic acid crosslinked alkylphenol-formaldehyde alkoxylates for this application.

Various water washing methods have been described. U.S. Pat. No. 4,407,707 discloses a method of removing particulate solids from hydrocarbon oil by adding to the oil an alkoxylated sorbitan fatty ester (optionally with an organo sulfonic acid or salt and/or a demulsifier), then washing the solids out of the oil with 5–50% water. U.S. Pat. No. 2,952,620 describes a process for removing solids from hydrocarbon oil by washing the oil with water containing a nonionic surfactant. Any nonionic surfactant which works with this water washing method is said to work. There is no hint or suggestion of such surfactants, which would implicitly include those of U.S. Pat. Nos. 4,407,707 and 4,539,099, having an effect in the absence of water washing. U.S. Pat. No. 4,889,618 discloses a process for removing solids from hydrocarbon oil by washing the oil with water containing concentrated caustic.

DETAILED DESCRIPTION OF THE INVENTION

The present invention relates to methods for accelerating the settling of finely divided, oil-and-water-insoluble solids in hydrocarbon fluids comprising adding to the hydrocarbon fluid an alkylphenol-formaldehyde resin alkoxylate. More particularly, the present invention relates to methods for accelerating the settling of spent fluid catalytic cracker (FCC) catalyst fines in an oil slurry comprising adding to the oil slurry an alkylphenol-formaldehyde resin alkoxylate.

The alkylphenol-formaldehyde resin alkoxylates generally have molecular weights in the range from about 500 to about 5,000 with a range of about 1,000 to about 2,500 preferred. The alkyl group may be linear or branched and have 1 to about 24 carbon atoms with a range of about 4 to about 9 preferred. The alkoxy group has about 2 to about 4 carbon atoms with 2 preferred. The alkoxylation comprises 20 to 80% by weight of the molecule with about 50% preferred.

The alkylphenol-formaldehyde resin alkoxylates, which for purposes of the present invention include mixtures of these compounds, prove effective in a variety of hydrocarbon fluids. These hydrocarbon fluids are generally unrefined hydrocarbons that are prone to containing finely divided, oil-and-water-insoluble solids. For purposes of the present invention, hydrocarbon fluids include but are not limited to crude oils and fractions or residuals of crude oils boiling over about 400° F.

Actual dosage ranges for the alkylphenol-formaldehyde resin alkoxylates depend upon the characteristics of the hydrocarbon to be treated. These characteristics can vary and include the type of hydrocarbon, the type and amount of finely divided solids present, the oil and water solubility of the finely divided solids, and the presence of other impurities and surfactants in the hydrocarbon fluid. For the purposes of this invention, the term "effective amount" is the amount of alkylphenol-formaldehyde resin alkoxylates necessary to accomplish the purpose of the treatment. The effective amount will range from about 1 part to about 1000 parts of alkylphenol-formaldehyde resin alkoxylates per million parts of hydrocarbon with a range of from about 10 to about 100 parts per million parts of hydrocarbon preferred.

The alkylphenol-formaldehyde resin alkoxylate can be fed to the hydrocarbon to be treated neat or in a suitable solvent that is compatible with the alkoxylate and the hydrocarbon. Examples of such solvents include but are not limited to petroleum distillates, aromatic naphthas, mineral oils, alkyl ethers, esters and alcohols.

The following examples are intended to show the efficacy of the present invention as an accelerator for settling finely divided, oil-and-water-insoluble solids in hydrocarbons and should not be construed as limiting the scope of the invention.

EXAMPLES

Catalyst Settling Aid Test

This test measures the fraction of FCC catalyst fines which settle to the bottom of a slurry sample compared to the amount which remains dispersed on top. This test simulates slurry settling in tankage between ambient temperature and 200° F.

Experimental

Collect 100 mL of FCCU slurry in 6 oz. bottles. Place bottles in a water bath and heat to process temperature. Remove each bottle from the bath and add the appropriate treatment to the desired bottles. Place the bottles in an insulated shaker and shake on high speed setting for 10 minutes. Return the bottles to the bath and allow to stand undisturbed for the predetermined settling period. This predetermined settling time for a blank is determined by analyzing several untreated bottles according to this test procedure at various time intervals centered on the tank's residence time (e.g., 5 hours, 1 day, 3 days, 7 days).

Test methods vary in the point at which the sample is split between the top and the bottom portions for analysis at the end of the settling period. The size of the top portion is used to designate the method used (e.g., the "95% method" means the top 95% of the sample was separated).

For most samples, the "50% method" described below is used. For extremely fast settling samples, a short settling time and the "95% method" described below is used. For very slow settling samples, a long settling time and the 20% or 10% variation of the 50% method is used.

50% method (or 20% or 10%)

Pipet off the top 50 mLs (or 20% or 10%) with a syringe being careful not to disturb the sample or insert the needle below the 50 (or 80 or 90) mL line, and transfer to a clean bottle. This is the "top" sample. The original bottle contains the "bottom" sample.

95% method

Pour off ~95 mLs (i.e., what will easily pour) into a clean bottle.

This is the "top" sample. The remaining ~5 mLs in the original bottle is the "bottom" sample.

Place filter pads in small petri dishes, dry uncovered at 220° F. for one hour, remove from oven and allow to cool in a desiccator.

Shake the oil sample vigorously and carefully pour it, up to 50 mL at a time, into a graduated 100 mL centrifuge tube, then double the volume, up to 100 mL, with xylene or toluene. Heat the centrifuge tube to 180° F. in a water bath. Centrifuge for 15 minutes.

Weigh and record filter weight. Place filter in a paraboloid filtration funnel and wet with xylene or toluene to ensure a good seal for vacuum filtration. Turn on the vacuum pump and pour a small amount of hot oil from the centrifuge tube into the filter funnel and allow it to filter. Rinse with xylene or toluene. Continue adding small amounts and rinsing until all the sample has been filtered. Then rinse centrifuge tube and funnel with more xylene or toluene until they are clean. Remove filter bowl and wash, under vacuum, the filter pad with xylene or toluene followed by petroleum ether or heptane.

Dry filter pad in an oven at 220° F. for one hour. Allow to cool in a desiccator and reweigh.

Place the filters in glass petri dishes and ash in a muffle furnace at ~900° F. Weigh again to determine catalyst weights, being careful not to disturb loose ash on filters.

The % settled is calculated by the following methods:

$$\underline{\text{20\% method}}\text{: \% settled} = \frac{\text{bottom} - 4 \times \text{top (g)}}{\text{bottom} + \text{top (g)}}$$

$$\underline{\text{50\% method}}\text{: \% settled} = \frac{\text{bottom} - \text{top (g)}}{\text{bottom} + \text{top (g)}}$$

$$\underline{\text{95\% method}}\text{: \% settled} = \frac{\text{bottom} - \text{top/19 (g)}}{\text{bottom} + \text{top (g)}}$$

A settling period which yields about 40 to 50% settled should be chosen. Repeat the optimal procedure, determined from the blanks, after adding chemical treatments at the process dosage.

Table I lists the various compounds tested and their individual chemical formulas.

TABLE I

Chemical legend

| Treatment | Description |
|---|---|
| A | $NR_5$—$EO_5$ (ac) |
| B | $NR_5$—$EO_5$ (bc) |
| C | $NR_5$—$EO_5$ (bc) + $NR_4$—$PO_1$—$EO_4$ (bc) |
| D | $BR_8$—$EO_3$ (ac) |
| E | $AR_4$—$EO_4$ (ac) + $NR_6$—$PO_1$—$EO_4$ (bc) |
| F | $NR_3$—$EO_5$ (ac) + $AR_4$—$EO_4$ (ac) |
| G | $NR_5$—$EO_5$ (bc) + $AR_4$—$EO_4$ (ac) |

N = nonylphenolic resin
B = butylphenolic resin
A = amylphenolic resin
$R_x$ = x moles of phenol per resin, on average
$EO_x$ = x moles of ethylene oxide per phenol, on average
$PO_x$ = x moles of propylene oxide per phenol, on average
(ac) = acid catalyzed resin
(bc) = base catalyzed resin The results of this testing are presented in Tables II to VII.

TABLE II

Southern Refinery
Settled 14 days at 170° F.
50% method
75 ppm active treatment

| Treatment | % Settled |
|---|---|
| A | −1 |
| B | 15 |
| C | 4 |
| D | 7 |
| E | 54 |
| F | 50 |
| G | 47 |
| Blank | 21 |

As demonstrated in Table II, a combination of amylpheno-formaldehyde ethoxylate resin and nonylphenol-formaldehyde ethylene oxide/propylene oxide resin proved most effective at settling oil-and-water-insoluble solids.

TABLE III

Mideastern Refinery
Settled 6 days at 170° F.
50% method
75 ppm active treatment

| | % Settled | |
|---|---|---|
| Treatment | Fluid #1 | Fluid #2 |
| A | −19* | 72 |
| B | 65* | 70 |
| C | 78 | |
| D | 75 | |
| E | 74 | |
| F | 79 | |
| G | 78 | |
| Blank | 72 | 70 |

*These tests were repeated due to a suspected procedural error.

TABLE IV

| Western Refinery<br>Settled 14 days at 70° F.<br>95% method<br>75 ppm active treatment | | | |
|---|---|---|---|
| | | % Settled | |
| Treatment | Fluid #1 | Fluid #2 | Fluid #3 |
| A | 93 | | |
| B | 98 | 93 | 85 |
| C | 93 | | |
| D | 92 | | |
| E | 91 | | |
| F | 94 | | |
| G | 92 | | |
| Blank | 92 | 88 | 75 |

These test results demonstrated that resin alkoxylates with various alkyl chains and combinations of resins with different alkyl chains are effective as settling aids. These results also demonstrated that combinations of acid catalyzed resins and base catalyzed resins are effective in the present invention.

Compound B was selected for further testing because, although it did not work for the first two applications, other, unrelated treatments worked well there, whereas, for the third application, no better treatment of any type can be found. This complementarity with alternative treatments made it the most valuable treatment even though it worked less often.

TABLE V

| Different Southern Refinery<br>Settled 1 day at 170° F.<br>50% and 95% methods<br>75 ppm active treatment | | |
|---|---|---|
| Treatment | 50% Method | 95% Method |
| B | 48 | 55 |
| Blank | 46 | 49 |

TABLE VI

| Second Mideastern Refinery<br>Settled 1 day at 200° F.<br>95% method<br>30 ppm active treatment | | |
|---|---|---|
| | % Settled | |
| Treatment | Fluid #1 | Fluid #2 |
| B | 16 | 21 |
| Blank | 17 | 13 |

The results in Tables V to VII demonstrate the effectiveness of the base catalyzed nonylphenol-formaldehyde resin ethoxylate at accelerating settling on a broad range of slurrys and at lower (30 ppm) treatment dosages. Compounds such as these are commercially available, for 15 example from BASF Corp. as Pluradyne DB-7935.

TABLE VII

| Third Mideastern Refinery<br>Settled 1 day at 160° F.<br>90% method, average of duplicates<br>75 ppm active treatment | |
|---|---|
| Treatment | % Settled |
| B | 85 |
| Blank | 66 |

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what I claim is:

1. A method for accelerating the settling of finely divided, oil insoluble and water insoluble solids in hydrocarbon fluids comprising adding to said hydrocarbon fluids an effective amount of an alkylphenol-formaldehyde resin alkoxylate.

2. The method as claimed in claim 1 wherein said alkylphenol-formaldehyde resin alkoxylate has a molecular weight range of about 500 to about 5,000.

3. The method as claimed in claim 1 wherein said alkylphenol-formaldehyde resin alkoxylate has a molecular weight range of about 1,000 to about 2,500.

4. The method as claimed in claim 1 wherein said alkylphenol-formaldehyde resin alkoxylate has an alkyl group range of 1 to about 24 carbon atoms.

5. The method as claimed in claim 1 wherein said alkylphenol-formaldehyde resin alkoxylate has an alkyl group range of about 4 to about 9 carbon atoms.

6. The method as claimed in claim 1 wherein said alkylphenol-formaldehyde resin alkoxylate has alkoxy groups ranging from about 2 to about 4 carbon atoms each.

7. The method as claimed in claim 1 wherein said alkoxylation comprises 20 to 80% of the weight of said alkylphenol-formaldehyde resin alkoxylate.

8. The method as claimed in claim 1 wherein said alkylphenol-formaldehyde resin alkoxylate is a base catalyzed nonylphenolic resin ethoxylate wherein the ethoxylation comprises about 50% of the weight of said ethoxylate.

9. The method as claimed in claim 1 wherein said finely divided oil insoluble and water insoluble solids are fluid catalytic cracker catalyst fines.

10. The method as claimed in claim 1 wherein said hydrocarbon fluid is selected from the group consisting of crude oils and fractions or residuals of crude oils having boiling points over 400° F.

11. The method as claimed in claim 1 wherein said hydrocarbon is a fluid catalytic cracker catalyst slurry.

12. The method as claimed in claim 1 wherein said alkylphenol-formaldehyde resin alkoxylate is added to said hydrocarbon in an amount ranging from about 1 part to about 1000 parts per million parts of hydrocarbon.

* * * * *